United States Patent [19]

Neyret et al.

[11] 4,423,611

[45] Jan. 3, 1984

[54] CYLINDER LOCK FOR VEHICLES

[75] Inventors: Guy Neyret; Alain Cadoux, both of Oullins, France

[73] Assignee: Sodex-Magister, Societe d'Exploitation des Brevets Neiman, Croissy, France

[21] Appl. No.: 255,951

[22] Filed: Apr. 20, 1981

[30] Foreign Application Priority Data

Apr. 30, 1980 [FR] France ..... 80 09822

[51] Int. Cl.[3] ..... E05B 17/18

[52] U.S. Cl. ..... 70/455

[58] Field of Search ..... 70/455, 423, 447, 431

[56] References Cited

U.S. PATENT DOCUMENTS

| | | | |
|---|---|---|---|
| 2,747,397 | 5/1956 | Jacobi | 70/455 |
| 3,122,013 | 2/1964 | Jacobi | 70/455 |
| 4,006,616 | 2/1977 | Rubner | 70/455 |

FOREIGN PATENT DOCUMENTS

| | | | |
|---|---|---|---|
| 1904999 | 10/1970 | Fed. Rep. of Germany | 70/455 |

*Primary Examiner*—Robert L. Wolfe

*Attorney, Agent, or Firm*—Dowell & Dowell

[57] ABSTRACT

The invention relates to a cylinder lock of the type comprising a cylinder rotatable in a bore of a body and controlled by a key sliding in a longitudinal passage of the cylinder, the entry of the key passage being blocked by a flap which pivots when the key is introduced.

According to the invention the said flap comprises a lug upon which there presses a slider which is movable at right angles to the key passage and subject to the action of a spring for returning the flap towards its closure position, the whole being lodged in a front cavity (12) of the head of the cylinder, which cavity is closed by a cap.

4 Claims, 5 Drawing Figures

CYLINDER LOCK FOR VEHICLES

BACKGROUND TO THE INVENTION

The invention relates to a cylinder lock of the type comprising a cylinder rotatable in a bore of a body and controlled by a key sliding in a longitudinal passage of the cylinder, the entry of the key passage being blocked by a flap which pivots when the key is introduced.

Locks of this type have very numerous applications, certain of which place the lock in contact with atmospheric agents, dust, etc. In this case it is known to close the key passage with a flap which can be moved aside. For such a flap various solutions have been proposed which are of high cost price, in particular because they do not permit automatic assembly.

OBJECT OF THE INVENTION

Consequently the invention aims at obtaining a lock of the above type which is to be of reduced cost price and the assembly of which is to be easily automatable.

SUMMARY OF THE INVENTION

To this end the lock according to the invention is characterised in that the said flap comprises a lug upon which there presses a slider which is movable at right angles to the key passage and is subject to the action of a spring for returning the flap towards its closure position, the assembly being lodged in a frontal cavity of the head of the cylinder, which cavity is closed by a cap.

The construction as just described permits of bringing in the various parts parallel with the axis of the cylinder, which thus permits automatic assembly.

BRIEF DESCRIPTION OF THE DRAWINGS

The invention will be clearly understood on reading of the following description, given with reference to the accompanying drawing, wherein.

DESCRIPTION OF PREFERRED EMBODIMENT

Figure 1:
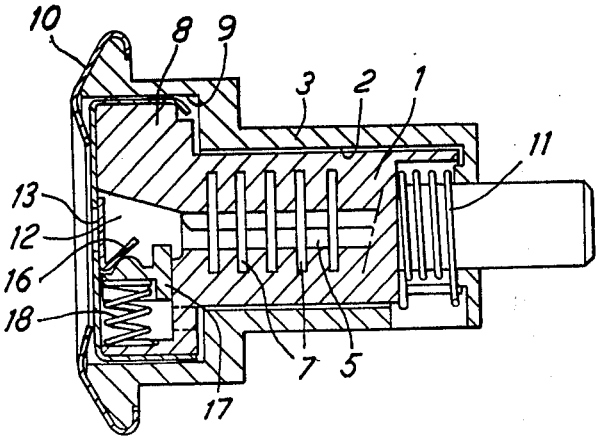
FIG. 1 is a longitudinal sectional view of a lock in accordance with an example of embodiment of the invention, the key being removed.
Figure 2:
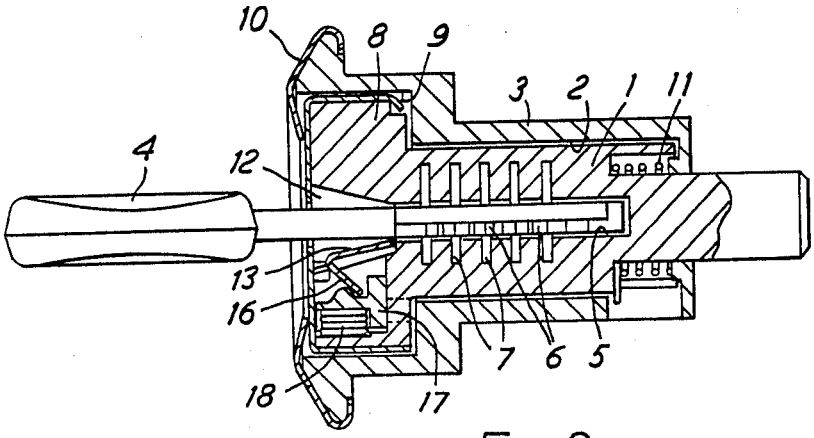
FIG. 2 is analogous with FIG. 1, the key being in place in the lock.

The lock as represented in the drawing comprises a cylinder 1 pivoting in a bore 2 of a body 3 by introduction of a key 4 into a longitudinal passage 5 of the cylinder. In known manner the key comprises coded notches 6 which transversely displace pallets (not shown) sliding in diametrical slots of the cylinder. The invention is equally applicable to piston-type locks.

The cylinder 1 comprises a head 8 of larger diameter lodged in a recess 9 in extension of the bore 2 of the body 3. The cylinder 1 is retained in the body 3 by a masking piece 10 crimped on to the body 3. In the example of embodiment as described the cylinder is subject to the action of a torsion spring 11 which urges it back into the unlocking position. The spring 11 is slightly axially compressed in such manner as to press the cylinder 1 against the masking piece 10 and thus to take up construction clearances.

Figure 4:
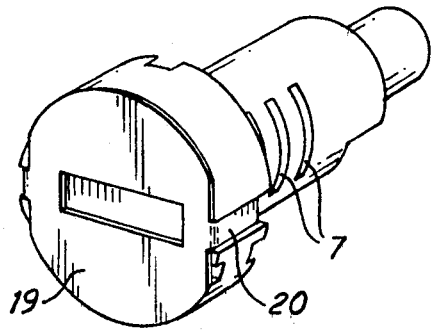
FIG. 4 is a perspective view of the assembled cylinder closed by a cap.
Figure 5:
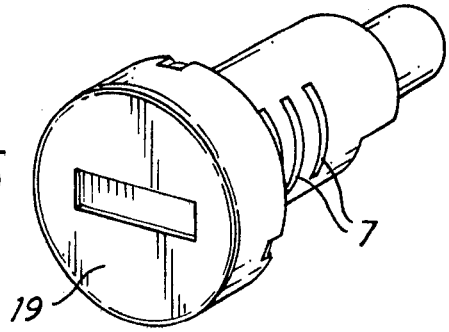
FIG. 5 is analogous with FIG. 4, but for a variant of the cap.

In the head 8 of the cylinder 1 there is formed a cavity 12 into which the key passage 5 opens. A flap 13 is mounted for pivoting in the cavity 12 by means of two studs 14 pivoting in two grooves 15 of the head 8. The flap 13 comprises a lug 16 turned towards the interior, upon which there presses a slider 17 pushed back by a spring 18. The assembly is closed by a crimped cap 19. In the form of embodiment according to FIG. 4, the cap 19 comprises two elastic tabs 20 which come to grip the periphery of the head 8. In the form of embodiment in FIG. 5 the cap is simply positioned with play, then crimped. The first form permits automatic orientation of the cap in its positioning.

Figure 3:
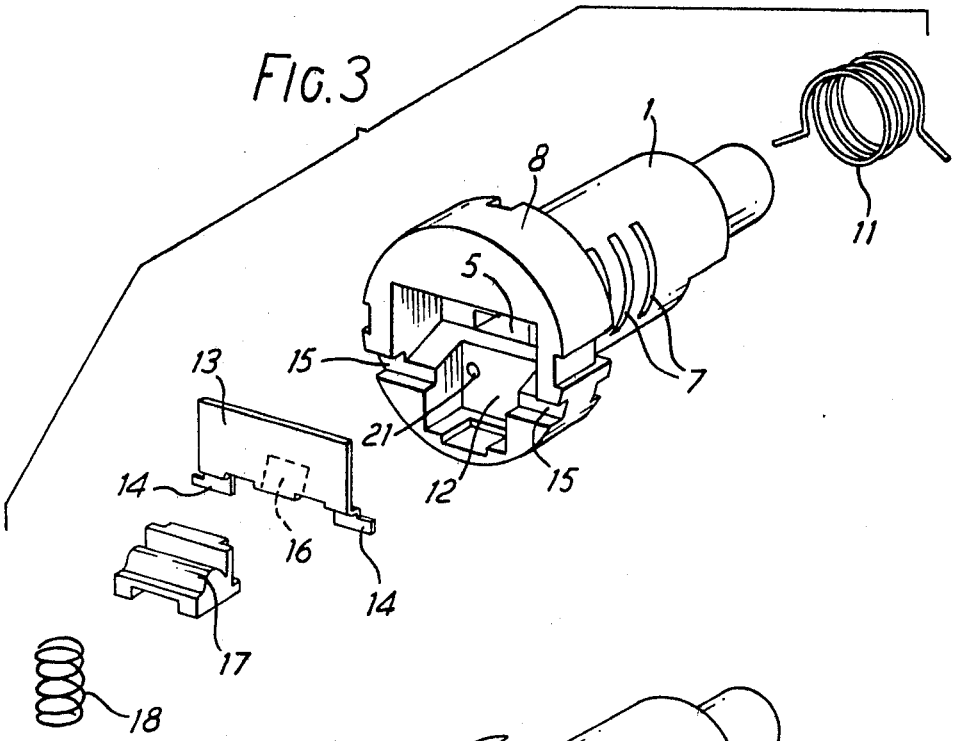
FIG. 3 is an exploded perspective view of the cylinder of the lock according to FIGS. 1 and 2.

For automatic assembly the slider 17 is set in the withdrawn position and held by two pins (not shown) which pass through the bottom of the cavity 12 in holes 21 (FIG. 3). Then the spring 18 is set in place in the compressed condition, then the flap 13; as the latter is not pushed by the slider it then permits the positioning of the cap 19. When the pins are withdrawn it is possible to check correct operation of the assembly by return of the flap 13 into the position closing the key entry.

We claim:

1. In a cylinder lock of the type comprising a cylinder rotatable in a bore of a body and controlled by a key sliding in a longitudinal passage of the cylinder, the entry of the key passage being closed by a flap which pivots when the key is introduced, the provision of:

(a) a slider which is movable at right angles to the key passage, (b) a spring for returning the flap towards its closure position, (c) a lug on said flap against which said slider presses the assembly being lodged in a front cavity of the head of the cylinder, and (d) a cap for closing said cavity.

2. Lock according to claim 1, wherein the cap comprises elastic tabs for positioning on the cylinder.

3. Lock according to claim 1, wherein the flap comprises two studs each pivoting in a groove of the cylinder.

4. Lock according to claim 1, wherein the cylinder is subject to the action of a slightly axially compressed torsion spring which pushes the cylinder against a masking piece fast with the casing.

* * * * *